United States Patent [19]

Van Dommelen et al.

[11] 4,324,075

[45] Apr. 13, 1982

[54] SELF SUPPORTING DAMP-PROOF COURSE

[76] Inventors: Dirk J. Van Dommelen; Christopher J. Greenup, both of 3B Park Rd., Alexandria, N.S.W. 2015, Australia

[21] Appl. No.: 74,439

[22] Filed: Sep. 11, 1979

[51] Int. Cl.[3] ..... E04B 2/00

[52] U.S. Cl. ..... 52/2; 52/169.14; 52/406; 52/743

[58] Field of Search ..... 52/411, 169.14, 2, 408, 52/743, 746, 406

[56] References Cited

U.S. PATENT DOCUMENTS

| | | | |
|---|---|---|---|
| 3,342,033 | 9/1967 | Crouch et al. | 52/743 UX |
| 4,001,989 | 1/1977 | Fischer | 52/743 X |
| 4,013,018 | 3/1977 | Hansen et al. | 52/2 X |
| 4,155,208 | 5/1979 | Shanabarger | 52/2 X |

FOREIGN PATENT DOCUMENTS

| | | | |
|---|---|---|---|
| 946323 | 1/1964 | United Kingdom | 52/169.14 |

*Primary Examiner*—Price C. Faw, Jr.
*Assistant Examiner*—Carl D. Friedman
*Attorney, Agent, or Firm*—Steinberg & Raskin

[57] ABSTRACT

The invention relates to a method of inserting a damp-proof course into an existing wall of a building which comprises the insertion of an elongate sealable bag or envelope and filling same with a quick-setting water-proof material.

The invention further relates to sealable bags or envelopes suitable for use in the establishment of a damp-proof course.

9 Claims, 4 Drawing Figures

SELF SUPPORTING DAMP-PROOF COURSE

This invention relates to a method of providing a damp-proof course (DPC) in the walls of buildings, or the like, where a DPC has not been provided, or the existing DPC has deteriorated or broken down and no longer provides a physical barrier to rising water.

A damp-proof course (DPC) is a physical barrier to water, which is usually inserted about 150 mm above the natural ground level. The barrier is not necessarily horizontal as vertical DPC's are used to prevent the passage of water from adjoining structures.

Any dampness in building is unpleasant and unhealthy and rising damp is no exception. Affected areas are cold, decorations are damaged, moulds may grow and paper peels from the walls. Further, rising damp may cause floor timbers to become damp and to be attacked by dry rot, which may spread to other timbers.

Bricks, stone and mortar, and similar materials, are porous and ground water carrying dissolved salts may rise many feet up a wall by capillary action unless preventative measures are taken. Generally, the finer the capillaries, the higher the water will rise against gravity.

In most houses built before the turn of the century, a DPC was not installed during the construction stage. It is now compulsory to insert some form of DPC during construction and these can take the form of bitumen, epoxy composites, polythene, aluminium, copper or lead sheet, or slate or engineering bricks in cement mortar. However, in many buildings, the DPC has failed due to inefficient laying or deterioration with age; it may have cracked because of settlement or perished because of chemical reaction or breakdown.

Where DPC's have not been laid or have failed, rising damp can be remedied by inserting a new DPC into the affected walls as a physical barrier to the rising water. A DPC can be inserted in walls of existing buildings, and in the past this has been a slow, tedious and relatively expensive procedure. According to known method, two or three adjacent bricks are removed from the damp affected wall along the line of the proposed new damp-proof course, a new membrane is then laid along the top of the exposed lower bricks and the bricks are then replaced, usually with new bricks because the process of removing the old bricks causes them to become severely damaged. As the new bricks are being replaced the mortar which is to be used to set the bricks into place and which is to fill up the spaces between the bricks must be applied laterally instead of from the top of each brick as it is when the wall is being built. This means that the mortar invariably slips off the bricks as it is being manoeuvred into place with the result that the wall does not have sufficient vertical support. This invariably results in most walls which have been treated in this manner, subsequently subsiding and causing cracks to appear and window frames or door frames to distort. In the case of a wall of thickness greater than one brick the problem of applying the supporting mortar in such a manner as to ensure sufficient upwards thrust is insurmountable. Pressure grouting of mortar has been attempted in the past in order to ensure that mortar covers the bricks throughout the entire thickness of the wall, but because the space between the new bricks forms a slot which is open at the back, the incoming mortar from the pressure device has nothing against which it can build up in order then to commence thrusting upwards and thus providing the necessary support to the wall.

A further objection to the traditional method of installing a new DPC into an existing wall is the fact that it is a time consuming job not only because of the need to remove and relay bricks etc., but also the fact that the mortar must be allowed time to set before the next succeeding section of walling can be treated. It is also expensive and creates considerable upheaval in the home or building being treated. In more recent times saws have been used to cut a transverse slot along a line of mortar jointing and a new membrane has been inserted in the slot so formed. The same objections regarding the complete filling of the slot with mortar which will provide an immediate and positive upwards thrust apply as described above.

In one aspect the present invention provides a method of inserting a damp-proof course into an existing wall of a building which comprises cutting a slot transversally through the wall along the proposed line of the DPC, inserting an elongate sealable bag or envelope of suitable dimensions into said slot, filling the bag or envelope under pressure with a quick setting waterproof material and allowing said waterproof material to set solid and to support that portion of the wall above the set waterproof material.

In a further aspect the present invention provides an elongate sealable bag or envelope, suitable for use in the above described method, the bag or envelope comprising an elongate inflatable tubular body sealed at both ends thereof fabricated from water impervious flexible film material and having valve means therein to allow the bag or envelope to be filled under pressure with a quick setting waterproof material.

This invention sets out to provide not only a new DPC comprising two layers of waterproof material with a further layer of waterproof material sandwiched between, but more importantly a positive system of providing complete support for the wall above the new DPC so that there is vertical upthrust almost immediately after the new DPC is inserted. This will get over the previous problems in this regard. Also, by using this method there will be virtually no mess caused in the building, there will be no subsiding of the treated walls, and the work will be completed in a significantly shorter time than by the present methods described above and at far less labour cost than hitherto.

The invention will now be further illustrated by reference to the drawings in which.

Figure 3:
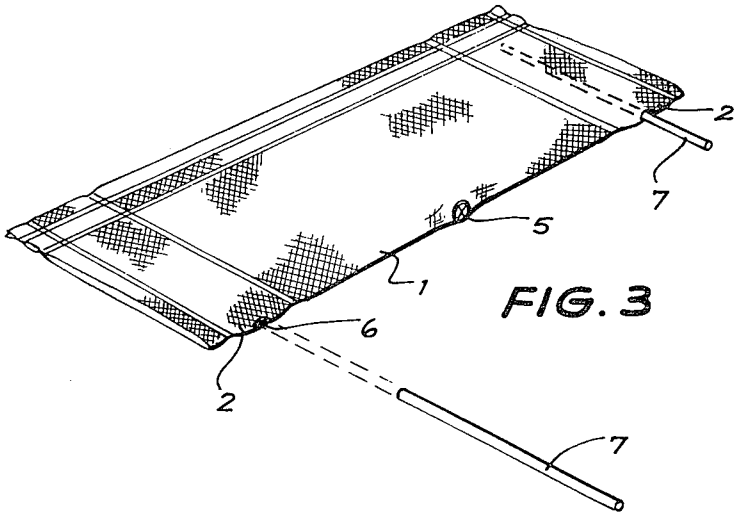
FIG. 3 is a perspective view of the bag illustrated in FIG. 1.
Figure 1:
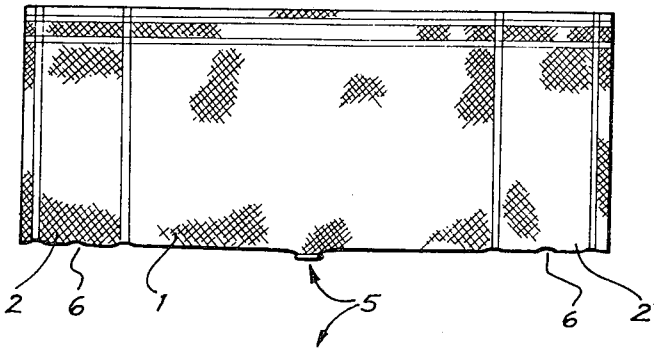
FIG. 1 represents a plan view of an elongate bag, according to the embodiment, illustrating the position of the end flaps or insertion pockets, and the filling valve.
Figure 2:
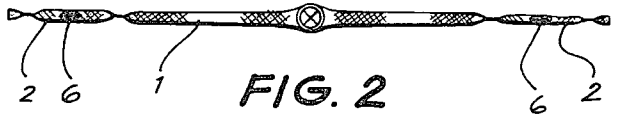
FIG. 2 is a side elevational view of the bag illustrated in FIG. 1.
Figure 4:
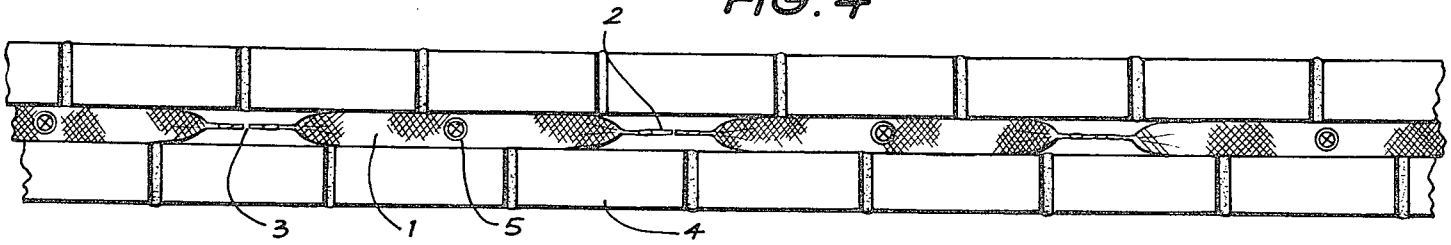
FIG. 4 is an illustration of several bags, according to an embodiment of the invention, in position as a DPC between two courses of bricks in a wall structure.

The DPC according to this embodiment of the invention comprises an elongate bag or envelope 1 defining a body portion or compartment of a width to suit the wall thickness and of a length to suit the length of a slot which has been cut transversally through the wall along the mortar course where the new DPC is to be inserted. The bag is manufactured in such a manner as to have included in its length two end pockets or flaps 2 suitable to be laid upon or under the adjacent end flap of the next succeeding bag (not illustrated) in order to provide a continuously waterproof layer on top of the lower brick course 4. Alternatively, the bags can be inserted into the slots cut into the wall, laid end to end without overlap, as shown at 3 in FIG. 4, and the gaps inbetween infilled with a suitable waterproof mortar. The bag consists of an impervious material such as polyethylene, or polyvinyl chloride (PVC), or the like, said bag being provided with means such as a non-return valve 5 for filling the bag with a quick setting waterproof material which is also capable of withstanding high compression loads. The bag with end pockets 2 is preferably formed by heat sealing of the bag material such that the separate compartments in the bag (two end pockets and central compartment inbetween) are formed by means of the seams so produced. The bag together with its filling material forms the new DPC comprising a layer of the set waterproof material sandwiched between two PVC film layers between adjacent courses of bricks. If desired, the upper and lower surfaces of the bag may be coated with a suitable adhesive material which, when the bag is filled will be pressed hard against both upper and lower brick surfaces to provide additional adhesion and ensuring there will be no possibility of slipping between the layers of brickwork in the event of any future earth tremors or other vibrations. The quicksetting material may be any suitable material which is capable of withstanding high compressive loads. In some instances, depending upon client or official preferences, it may be a quick-setting epoxy mix, in other cases a quick-setting cement mortar mix containing waterproofing additives. In the case of epoxy mixes the filling valve also forms the mixing chamber wherein the two separate epoxies are mixed thoroughly prior to entering the bag. In either case the filling materials are injected under pressure from suitable pumps or pressure vessels.

The method of inserting the new DPC according to the present invention comprises cutting a horizontal slot transversally through the wall at the new DPC level, preferably for a distance of approximately 800 to 1000 mm. The two end pockets of each bag are preferably provided with push-rod insertion holes 6 in the same edge of the bag which houses the filling valve. Suitable rods 7 are inserted through the holes 6 to facilitate insertion of the bag 1 into the pre-cut slot in the wall. The flaps 2 of adjacent bags 1 are either arranged in close juxtaposition or are made to overlap to provide a continuous layer. The bag at this stage would lie perfectly flat having had any inside air completely exhausted. The bag is then filled under suitable pressure either from a pump or pressure vessel with the waterproof material which has been selected.

The immediate effect of the bag being filled is to provide an upward thrust where it is most needed. When the bag is completely full, the hardening process continues until the waterproof material has set solid and is immediately able to support the wall above thus enabling the operator to proceed to the next succeeding transverse cut along the new line of DPC.

The second and succeeding bags should be inserted in such a manner that adjacent end flaps are in close juxtaposition, or such that there is an effective overlapping of the flaps of adjacent bags. After the whole length of wall has been treated the plastic valves can be cut off and if desired the exposed edges of the now inflated bags can be covered with a waterproof mortar to form a neat seam along the entire length of the new DPC. As a variation of this finishing off process, the bags can be manufactured to a slightly wider width than the wall which is to be treated and the extra width of bag be allowed to overhang the brickwork on each side of the wall. After the work has been completed the bags which are now filled with solid set mortar and which are overhanging the brickwork can be sheared off flush with the faces of the bricks to form a neat mortar seam. Any gaps between adjacent bags or between the bags and the wall can be filled with a suitable waterproof mortar. The slotting of the walls is preferably carried out by means of specially adapted chain saw equipped with diamond or carbide teeth suitable for cutting into masonry such as brick, cement blocks or stone or a newly developed ring saw. Either method of cutting may be provided with means of extracting dust or chippings to eliminate mess caused by the cutting process.

Although the invention has been described above with reference to preferred embodiments, it will be appreciated that numerous variations, modifications or alternatives may be substituted for specifically described features, without departing from the spirit or scope of the invention as broadly described.

What we claim is:

1. A method of inserting a damp-proof course into an existing wall of a building which comprises cutting a slot transversally through the wall along the proposed line of the DPC, inserting an elongate sealable bag or envelope of suitable dimensions into said slot, filling the bag or envelope under pressure with a quick setting waterproof material and allowing said waterproof material to set solid and to support that portion of the wall above the set waterproof material.

2. A method according to claim 1, wherein a plurality of said sealable bags or envelopes are inserted into an elongate slot cut transversely through the wall along the proposed line of the DPC, wherein said bags are placed end to end with any gaps therebetween being infilled with a waterproof material.

3. A method according to claim 1, wherein a plurality of said sealable bags or envelopes are inserted into an elongate slot cut transversally through the wall along the proposed line of the DPC, wherein an end of any one said envelope overlaps the end of the next adjacent envelope.

4. A method according to claim 1, wherein the upper and/or lower surface(s) of the envelope are coated with adhesive or mortar material to provide adhesion to the adjacent surface(s) of the wall.

5. A method according to claim 1, wherein the exposed edges of the filled envelope in said slot are covered with waterproof mortar to form a continuous layer along the entire length of the DPC.

6. A method according to claim 1, wherein said bag or envelope is wider than the width of the wall, and wherein after the waterproof material has set that portion of the bag or envelope protruding from the wall can be sheared off flush with the face of the wall.

7. An elongate sealable bag or envelope fabricated from water-impervious flexible film material for insertion into a slot of a wall, comprising a central elongate inflatable tubular body compartment having valve means therein for allowing said body to be filled under pressure with a quick-setting water proof material, said body compartment being sealed along all side edges thereof and having along at least one edge a separate extension characterized in that said extension is formed as a non-inflatable pocket integral with said body compartment, wherein said non-inflatable pocket includes opening means therein for insertion of elongate means into said non-inflatable pocket to facilitate insertion of said bag or envelope into the slot cut into the wall.

8. An elongate sealable bag or envelope fabricated from water impervious flexible film material comprising an elongate inflatable tubular body portion having valve means therein to allow the body portion of said bag or envelope to be filled under pressure with a quick setting waterproof material and said valve means including means to allow mixing of separate components of a settable epoxy material with which the bag is to be filled, said body portion being sealed along all side edges thereof and having along at least one side edge thereof a non-inflatable flap pocket integral with or attached to the inflatable body portion of said bag or envelope, said flap pocket being of sufficient proportions to overlap the side edges of another said bag or envelope.

9. An elongate sealable bag or envelope fabricated from water impervious flexible film material comprising an elongate inflatable tubular body portion having valve means therein to allow the body portion of said bag or envelope to be filled under pressure with a quick setting waterproof material, said body portion being sealed along all side edges thereof and having along at least one side edge thereof a non-inflatable flap pocket integral with or attached to the inflatable body portion of said bag or envelope, said flap pocket being of sufficient proportions to overlap the side edges of another said bag or envelope and including an opening for insertion of elongate means to facilitate insertion of said bag or envelope into a slot cut into a wall.

* * * * *